US007824216B2

(12) United States Patent
Purdy

(10) Patent No.: US 7,824,216 B2
(45) Date of Patent: Nov. 2, 2010

(54) COAXIAL CABLE CONTINUITY CONNECTOR

(75) Inventor: Eric Purdy, Constantia, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/472,368

(22) Filed: May 26, 2009

(65) Prior Publication Data

US 2010/0255719 A1 Oct. 7, 2010

Related U.S. Application Data

(60) Provisional application No. 61/166,247, filed on Apr. 2, 2009.

(51) Int. Cl.
*H01R 9/05* (2006.01)

(52) U.S. Cl. ..... 439/578; 439/585

(58) Field of Classification Search ..... 439/578–585
See application file for complete search history.

(56) References Cited

U.S. PATENT DOCUMENTS

| | | | |
|---|---|---|---|
| 2,480,963 | A | 9/1949 | Quinn |
| 2,694,187 | A | 11/1954 | Nash |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,196,382 | A | 7/1965 | Morello, Jr. |
| 3,245,027 | A | 4/1966 | Ziegler, Jr. |
| 3,278,890 | A | 10/1966 | Cooney |
| 3,281,757 | A | 10/1966 | Bonhomme |
| 3,320,575 | A | 5/1967 | Brown et al. |
| 3,551,882 | A | 12/1970 | O'Keefe |
| 3,665,371 | A | 5/1972 | Cripps |
| 3,669,472 | A | 6/1972 | Nadsady |
| 3,678,455 | A | 7/1972 | Brancaleone |
| 3,683,320 | A | 8/1972 | Woods et al. |
| 3,686,623 | A | 8/1972 | Nijman |

(Continued)

FOREIGN PATENT DOCUMENTS

| | | |
|---|---|---|
| DE | 1191880 | 4/1965 |

(Continued)

OTHER PUBLICATIONS

U.S. Appl. No. 12/783,131; Filed May 19, 2010.

(Continued)

*Primary Examiner*—Thanh-Tam T Le
(74) *Attorney, Agent, or Firm*—Schmeiser, Olsen & Watts

(57) ABSTRACT

A coaxial cable continuity connector comprising a connector body, a post engageable with connector body, wherein the post includes a flange having a tapered surface, a nut, wherein the nut includes an internal lip having a tapered surface, wherein the tapered surface of the nut oppositely corresponds to the tapered surface of the post when the nut and post are operably axially located with respect to each other when the coaxial cable continuity connector is assembled, and a continuity member disposed between and contacting the tapered surface of the post and the tapered surface of the nut, so that the continuity member endures a moment resulting from the contact forces of the opposite tapered surfaces, when the continuity connector is assembled, is provided.

15 Claims, 9 Drawing Sheets

U.S. PATENT DOCUMENTS 3,739,076 A 6/1973 Schwartz
3,744,007 A 7/1973 Horak
3,778,535 A 12/1973 Forney, Jr.
3,793,610 A 2/1974 Brishka
3,835,443 A 9/1974 Arnold et al.
3,879,102 A 4/1975 Horak
3,953,097 A 4/1976 Graham
3,963,321 A 6/1976 Burger et al.
3,970,355 A 7/1976 Pitschi
4,046,451 A * 9/1977 Juds et al. ..... 439/583
4,079,343 A 3/1978 Nijman
4,082,404 A 4/1978 Flatt
4,093,335 A 6/1978 Schwartz et al.
4,106,839 A 8/1978 Cooper
4,125,308 A 11/1978 Schilling
4,153,320 A 5/1979 Townshend
4,173,385 A 11/1979 Fenn et al.
4,174,875 A 11/1979 Wilson et al.
4,187,481 A 2/1980 Boutros
4,229,714 A 10/1980 Yu
4,389,081 A 6/1983 Gallusser et al.
4,426,127 A 1/1984 Kubota
4,506,943 A 3/1985 Drogo
4,525,017 A 6/1985 Schildkraut et al.
4,531,805 A 7/1985 Werth
4,545,637 A 10/1985 Bosshard et al.
4,580,865 A 4/1986 Fryberger
4,583,811 A 4/1986 McMills
4,634,213 A 1/1987 Larsson et al.
4,734,050 A 3/1988 Negre et al.
4,734,666 A 3/1988 Ohya et al.
4,737,123 A 4/1988 Paler et al.
4,749,821 A 6/1988 Linton et al.
4,761,146 A 8/1988 Sohoel
4,808,128 A 2/1989 Werth
4,836,801 A 6/1989 Ramirez
4,867,706 A 9/1989 Tang
4,902,246 A 2/1990 Samchisen
4,929,188 A 5/1990 Lionetto et al.
4,938,718 A 7/1990 Guendel
5,002,503 A 3/1991 Campbell et al.
5,011,432 A 4/1991 Sucht et al.
5,030,126 A 7/1991 Hanlon
5,080,600 A 1/1992 Baker et al.
5,083,943 A 1/1992 Tarrant
5,137,470 A * 8/1992 Doles ..... 439/578
5,137,471 A 8/1992 Verespej et al.
5,186,501 A 2/1993 Mano
5,186,655 A 2/1993 Glenday et al.
5,215,477 A 6/1993 Weber et al.
5,217,393 A 6/1993 Del Negro et al.
5,295,864 A 3/1994 Birch et al.
5,380,211 A 1/1995 Kawaguchi et al.
5,413,504 A 5/1995 Kloecker et al.
5,439,386 A 8/1995 Ellis et al.
5,444,810 A 8/1995 Szegda
5,474,478 A 12/1995 Ballog
5,607,325 A 3/1997 Toma
5,667,405 A 9/1997 Holliday
5,683,263 A 11/1997 Hse
5,877,452 A 3/1999 McConnell
5,879,191 A 3/1999 Burris
5,882,226 A 3/1999 Bell et al.
5,938,465 A 8/1999 Fox, Sr.
5,957,716 A 9/1999 Buckley et al.
5,975,951 A 11/1999 Burris et al.
5,997,350 A 12/1999 Burris et al.
6,019,635 A 2/2000 Nelson
6,022,237 A 2/2000 Esh
6,217,383 B1 4/2001 Holland et al.
6,239,359 B1 5/2001 Lilienthal, II et al.
6,271,464 B1 8/2001 Cunningham
6,332,815 B1 12/2001 Bruce
6,422,900 B1 7/2002 Hogan
6,425,782 B1 7/2002 Holland
6,540,531 B2 4/2003 Syed et al.
6,558,194 B2 5/2003 Montena
6,572,419 B2 6/2003 Feye-Homann
6,576,833 B2 6/2003 Covaro et al.
6,676,446 B2 1/2004 Montena
6,683,253 B1 1/2004 Lee
6,692,285 B2 2/2004 Islam
6,712,631 B1 3/2004 Youtsey
6,716,062 B1 4/2004 Palinkas et al.
6,767,248 B1 7/2004 Hung
6,786,767 B1 9/2004 Fuks et al.
6,790,081 B2 9/2004 Burris et al.
6,848,940 B2 2/2005 Montena
6,971,912 B2 12/2005 Montena et al.
7,097,499 B1 * 8/2006 Purdy ..... 439/578
7,114,990 B2 * 10/2006 Bence et al. ..... 439/583
7,118,416 B2 10/2006 Montena et al.
7,252,546 B1 * 8/2007 Holland ..... 439/584
7,255,598 B2 * 8/2007 Montena et al. ..... 439/578
7,479,035 B2 1/2009 Bence et al.
7,566,236 B2 7/2009 Malloy et al.
2003/0214370 A1 11/2003 Allison et al.
2004/0209516 A1 10/2004 Burris et al.
2008/0102696 A1 * 5/2008 Montena ..... 439/578

FOREIGN PATENT DOCUMENTS

DE 3211008 A1 10/1983
DE 9001608.4 U1 4/1990
EP 0265276 A2 4/1988
EP 0428424 A2 5/1991
EP 1191268 A1 3/2002
FR 2312918 12/1976
GB 1087228 A 10/1967
GB 1270846 A 4/1972
GB 2079549 A 1/1982
GB 2252677 A 8/1992
WO 2004013883 A2 2/2004

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.
U.S. Appl. No. 12/633,792; Filed Dec. 8, 2009.

* cited by examiner

COAXIAL CABLE CONTINUITY CONNECTOR

CROSS-REFERENCE TO RELATED APPLICATIONS

This application claims the priority benefit of U.S. Provisional Patent Application No. 61/166,247 filed Apr. 2, 2009, and entitled COAXIAL CABLE CONTINUITY CONNECTOR.

FIELD OF THE INVENTION

The present invention relates to F-type connectors used in coaxial cable communication applications, and more specifically to connector structure extending continuity of an electromagnetic interference shield from the cable and through the connector.

BACKGROUND OF THE INVENTION

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. Moreover, structure of common connectors may permit loss of ground and discontinuity of the electromagnetic shielding that is intended to be extended from the cable, through the connector, and to the corresponding coaxial cable interface port. Hence a need exists for an improved connector for ensuring ground continuity between the coaxial cable, the connector structure, and the coaxial cable connector interface port.

SUMMARY OF THE INVENTION

A first aspect of the present invention provides a coaxial cable continuity connector comprising; a connector body; a post engageable with connector body, wherein the post includes a flange having a tapered surface; a nut, wherein the nut includes an internal lip having a tapered surface, wherein the tapered surface of the nut oppositely corresponds to the tapered surface of the post when the nut and post are operably axially located with respect to each other when the coaxial cable continuity connector is assembled; and a continuity member disposed between and contacting the tapered surface of the post and the tapered surface of the nut, so that the continuity member endures a moment resulting from the contact forces of the opposite tapered surfaces, when the continuity connector is assembled.

A second aspect of the present invention provides a coaxial cable continuity connector comprising; a connector body a nut rotatable with respect to the connector body, wherein the nut includes an internal lip having a tapered surface; a post securely engageable with connector body, wherein the post includes a flange having a tapered surface, wherein the tapered surface of the post oppositely corresponds to the tapered surface of the nut when the post and the nut are operably axially located with respect to each other, when the coaxial cable continuity connector is assembled; and a continuous ground path located between the nut and the post, the ground path facilitated by the disposition of a continuity member positioned between the tapered surface of the nut and the tapered surface of the post to continuously contact the nut and the post under a pre-load condition, wherein the continuity member is continuously compressed by a resultant moment existent between oppositely tapered surfaces of the nut and the post, when the continuity connector is assembled.

A third aspect of the present invention provides a coaxial cable continuity connector comprising: a post, axially secured to a connector body; a nut, coaxially rotatable with respect to the post and the connector body, when the coaxial cable continuity connector is assembled; and means for extending a continuous electrical ground path between the nut and the post, when the coaxial cable continuity connector is assembled, wherein the means invoke a moment existent between opposing surfaces of the nut and the post, when the coaxial cable continuity connector is assembled.

A fourth aspect of the present invention provides a method of extending an electrical ground path from a coaxial cable, through a coaxial cable connector, to an interface port, the method comprising: providing a coaxial cable continuity connector including: a connector body; a post engageable with connector body, wherein the post includes a flange having a tapered surface; a nut, wherein the nut includes an internal lip having a tapered surface, wherein the tapered surface of the nut oppositely corresponds to the tapered surface of the post when the nut and post are operably axially located with respect to each other when the coaxial cable continuity connector is assembled; and a continuity member disposed between and contacting the tapered surface of the post and the tapered surface of the nut, so that the continuity member endures a moment resulting from the contact forces of the opposite tapered surfaces, when the continuity connector is assembled; assembling the coaxial cable continuity connector; operably attaching a coaxial cable to the coaxial cable continuity connector in a manner that electrically integrates the post and an outer conductor of the coaxial cable; and installing the assembled connector, having the attached coaxial cable, to an interface port to extend an electrical ground path from the coaxial cable, through the post and the nut of the coaxial cable continuity connector, to the interface port.

The foregoing and other features of construction and operation of the invention will be more readily understood and fully appreciated from the following detailed disclosure, taken in conjunction with accompanying drawings.

DETAILED DESCRIPTION

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
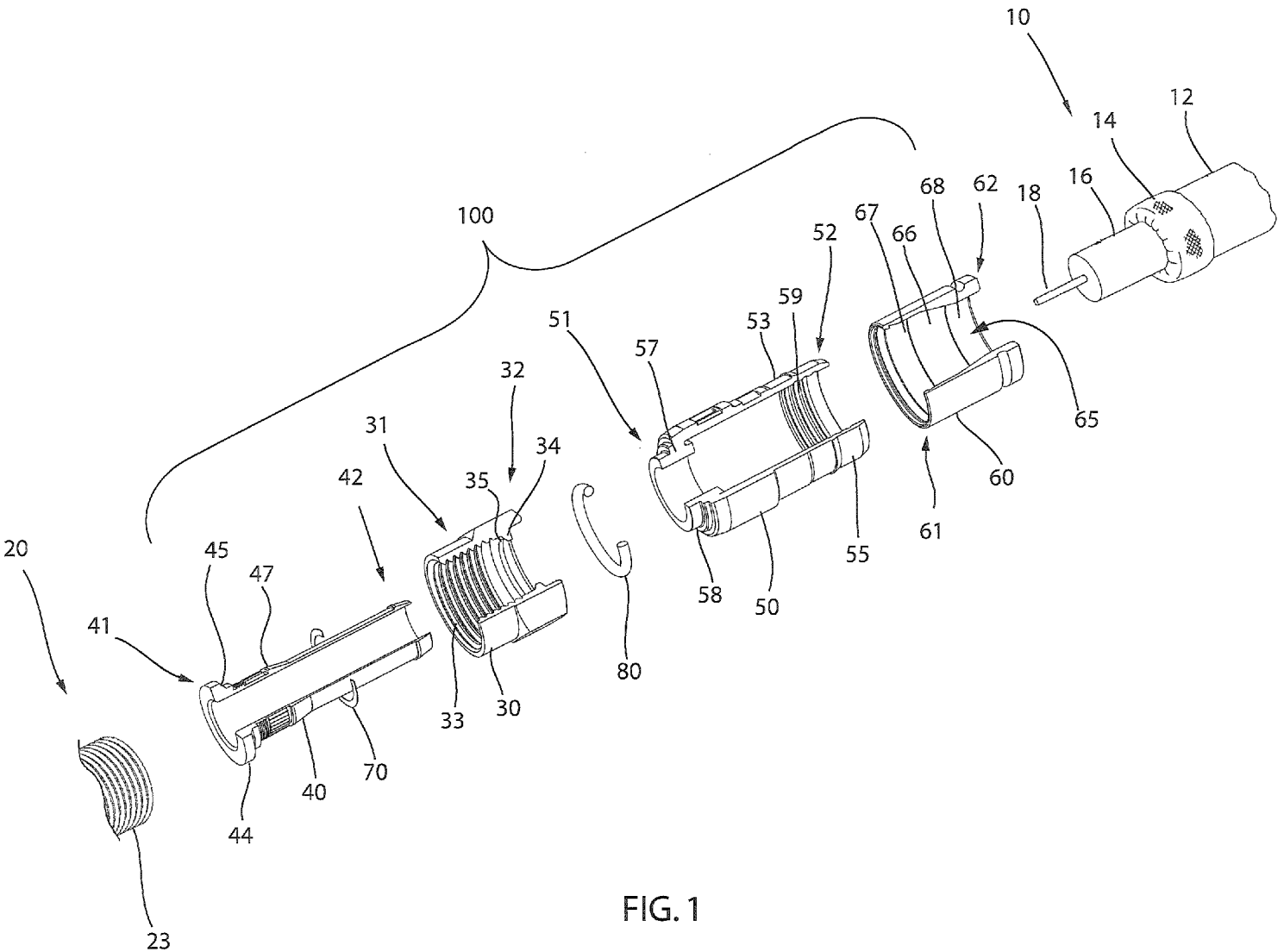
FIG. 1 depicts an exploded perspective view of an embodiment of the elements of an embodiment of a coaxial cable continuity connector, in accordance with the present invention.

Referring to the drawings, FIG. 1 depicts one embodiment of a continuity connector 100. The continuity connector 100 may be operably affixed to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to preventingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the continuity connector 100 may also include a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. In addition, the coaxial cable interface port 20 may comprise a mating edge 26 (shown in FIG. 9). It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with coaxial cable connectors, such as, for example, a continuity connector 100. However, the conductive receptacle 22 should be formed of a conductive material. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, an embodiment of a coaxial cable connector 100 may further comprise a threaded nut 30, a post 40, a connector body 50, a fastener member 60, a continuity member 70, such as, for example, a ring washer formed of conductive material, and a connector body sealing member 80, such as, for example, a body O-ring.

Figure 8:
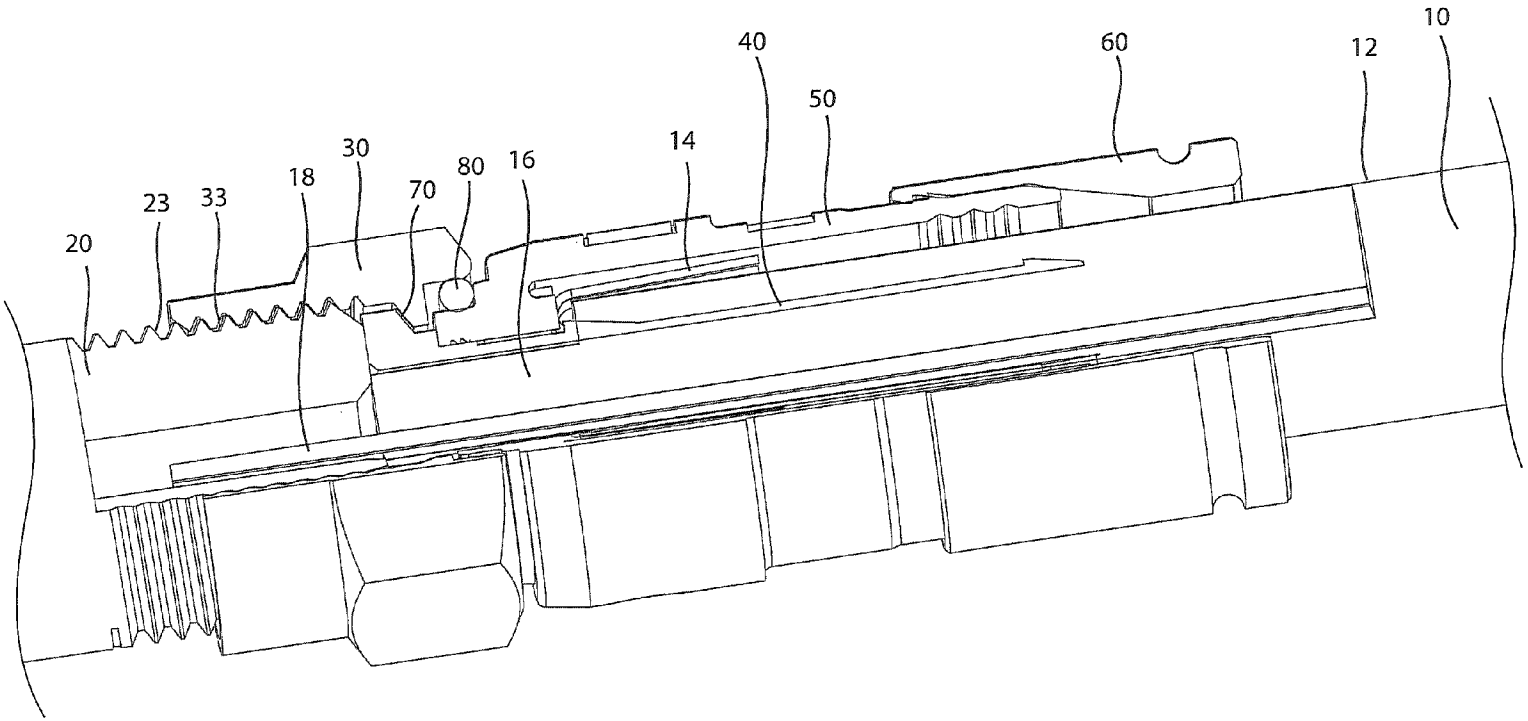
FIG. 8 depicts a perspective cut-away view of an embodiment of a continuity connector having an attached coaxial cable, the connector in a fully tightened position on an interface port, in accordance with the present invention.
Figure 9:
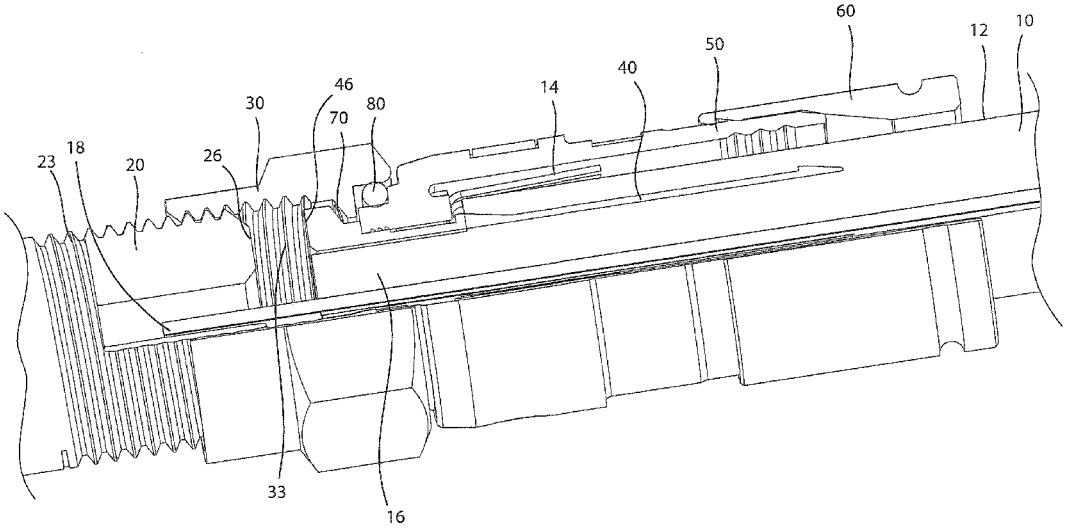
FIG. 9 depicts a perspective cut-away view of an embodiment of a continuity connector having an attached coaxial cable, the connector in a not fully tightened position on an interface port, in accordance with the present invention.

The threaded nut 30 of embodiments of a continuity connector 100 has a first end 31 and opposing second end 32. The threaded nut 30 may comprise internal threading 33 extending axially from the edge of first end 31 a distant sufficient to provide operably effective threadable contact with the external threads 23 of a standard coaxial cable interface port 20 (as shown in FIGS. 1, 8 and 9). The threaded nut 30 includes an internal lip 34, such as an annular protrusion, located proximate the second end 32 of the nut. The internal lip 34 includes a tapered surface 35 facing the first end 31 of the nut 30. The tapered surface 35 forms a non-radial face and may extend at any non-perpendicular angle with respect to the central axis of the continuity connector 100. The structural configuration of the nut may vary according to accommodate different functionality of a coaxial cable connector 100. For instance, the first end 31 of the nut 30 may include internal and/or external structures such as ridges grooves, curves, detents, slots, openings, chamfers, or other structural features, etc., which may facilitate the operable joining of an environmental sealing member, such an Aqua-Tight seal, that may help preventingress of environmental contaminants at the first end 31 of a nut 30, when mated with an interface port 20. Moreover, the second end 32, of the nut 30 may extend a significant axial distance to reside radially extent of the connector body 50, although the extended portion of the nut 30 need not contact the connector body 50. The threaded nut 30 may be formed of conductive materials facilitating grounding through the nut. Accordingly the nut 30 may be configured to extend an electromagnetic buffer by electrically contacting conductive surfaces of an interface port 20 when a connector 100 (shown in FIGS. 6, 8 and 9) is advanced onto the port 20. In addition, the threaded nut 30 may be formed of both conductive and non-conductive materials. For example, portions of the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, or other fabrication methods that may provide efficient production of the component.

Referring still to, FIG. 1, an embodiment of a continuity connector 100 may include a post 40. The post 40 comprises a first end 41 and opposing second end 42. Furthermore, the post 40 comprises a flange 44, such as an externally extending annular protrusion, located at the first end 41 of the post 40. The flange 44 includes a tapered surface 45 facing the second end 42 of the post 40. The tapered surface 45 forms a non-radial face and may extend at any non-perpendicular angle with respect to the central axis of the continuity connector 100. The angle of the taper of the tapered surface 45 should oppositely correspond to the angle of the taper of the tapered surface 35 of the internal lip 34 of threaded nut 30. Further still, an embodiment of the post 40 may include a surface feature 47 such as a lip or protrusion that may engage a portion of a connector body 50 to secure axial movement of the post 40 relative to the connector body 50. Additionally, the post 40 may include a mating edge 46. The mating edge 46 may be configured to make physical and electrical contact with a corresponding mating edge 26 of an interface port 20. The post 40 should be formed such that portions of a prepared coaxial cable 10 including the dielectric 16 and center conductor 18 (shown in FIGS. 1, 8 and 9) may pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post may be formed of a combination of both conductive and non-conductive materials. For example, a metal coating or layer may be applied to a polymer or other non-conductive material. Manufacture of the post 40 may include casting, extruding, cutting, turning, drilling, injection molding, spraying, blow molding, component overmolding, or other fabrication methods that may provide efficient production of the component.

Embodiments of a coaxial cable connector, such as continuity connector 100, may include a connector body 50. The connector body 50 may comprise a first end 51 and opposing second end 52. Moreover, the connector body 50 may include a post mounting portion 57 proximate the first end 51 of the body 50, the post mounting portion 57 configured to mate and achieve purchase with a portion of the outer surface of post 40, so that the connector body 50 is axially and radially secured to the post 40. When embodiments of a continuity connector are assembled (as in FIGS. 6-8), the connector body 50 may be mounted on the post 40 in a manner that prevents contact of the connector body 50 with the nut 30. In addition, the connector body 50 may include an outer annular recess 58 located proximate the first end 51. Furthermore, the connector body 50 may include a semi-rigid, yet compliant outer surface 55, wherein the outer surface 55 may be configured to form an annular seal when the second end 52 is deformably compressed against a received coaxial cable 10 by operation of a fastener member 60. The connector body 50 may include an external annular detent 53 located proximate the second end 52 of the connector body 50. Further still, the connector body 50 may include internal surface features 59, such as annular serrations formed proximate the internal surface of the second end 52 of the connector body 50 and configured to enhance frictional restraint and gripping of an inserted and received coaxial cable 10. The connector body 50 may be formed of materials such as, plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, injection molding, spraying, blow molding, component overmolding, or other fabrication methods that may provide efficient production of the component.

With further reference to FIG. 1, embodiments of a continuity connector 100 may include a fastener member 60. The fastener member 60 may have a first end 61 and opposing second end 62. In addition, the fastener member 60 may include an internal annular protrusion 63 located proximate the first end 62 of the fastener member 60 and configured to mate and achieve purchase with the annular detent 53 on the outer surface 55 of connector body 50 (shown in FIGS. 4 and 6). Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. Additionally, the fastener member 60 may comprise an exterior surface feature 69 positioned proximate with the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, hard plastics, polymers, composites and the like. Furthermore, the fastener member 60 may be manufactured via casting, extruding, cutting, turning, drilling, injection molding, spraying, blow molding, component overmolding, or other fabrication methods that may provide efficient production of the component.

The manner in which the continuity connector 100 may be fastened to a received coaxial cable 10 (such as shown in FIGS. 1, 8 and 9) may also be similar to the way a cable is fastened to a common CMP-type connector. The continuity connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate the first end 41 of the tubular post 40 and cooperates in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 and may be displaceable axially between a first open position (accommodating insertion of the tubular inner post 40 into a prepared cable 10 end to contact the grounding shield 14), and a second clamped position compressibly fixing the cable 10 within the chamber of the connector 100. A coupler or nut 30 at the front end of the inner post 40 serves to attach the continuity connector 100 to an interface port. In a CMP-type continuity connector 100, the structural configuration and functional operation of the nut 30 may be similar to the structure and functionality of similar components of a continuity connector 100 described in FIGS. 1-9, and having reference numerals denoted similarly. In addition, those in the art should appreciate that other means, such as crimping, thread-on compression, or other connection structures and or processes may be incorporated into the operable design of a continuity connector 100.

Figure 2:
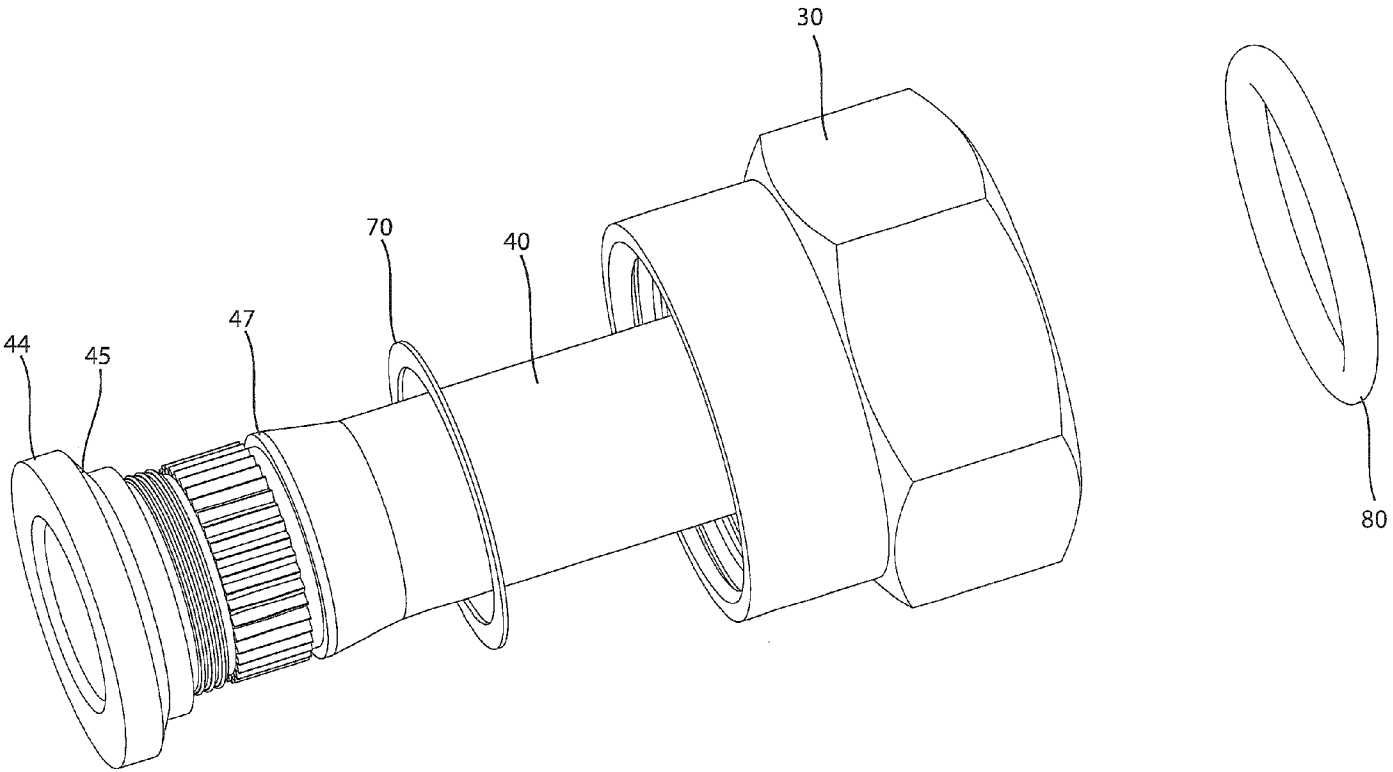
FIG. 2 depicts an exploded perspective view of a portion of an embodiment of a continuity connector during assembly, in accordance with the present invention.
Figure 3:
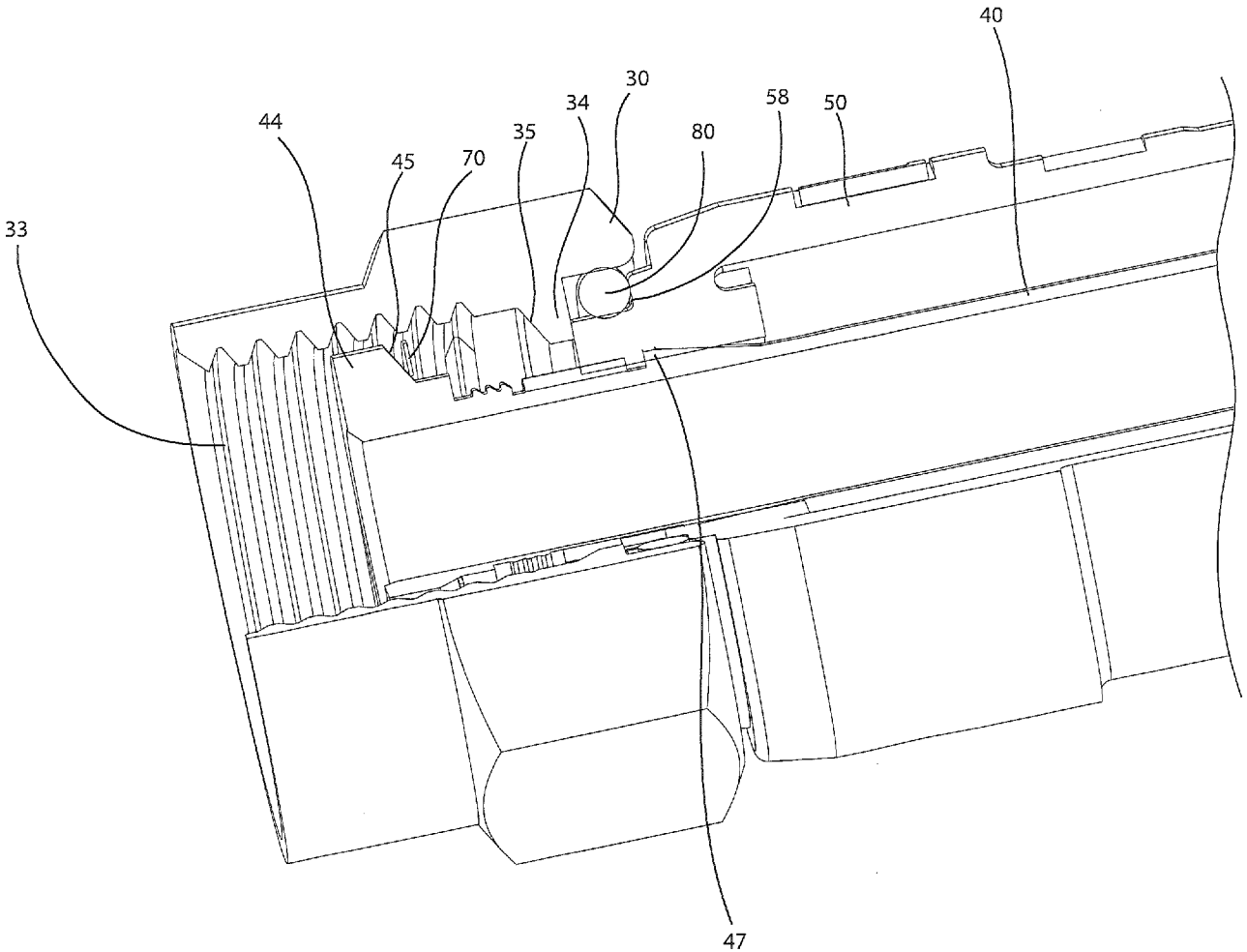
FIG. 3 depicts a side view of a portion of an embodiment of a continuity connector during assembly, in accordance with the present invention.
Figure 4:
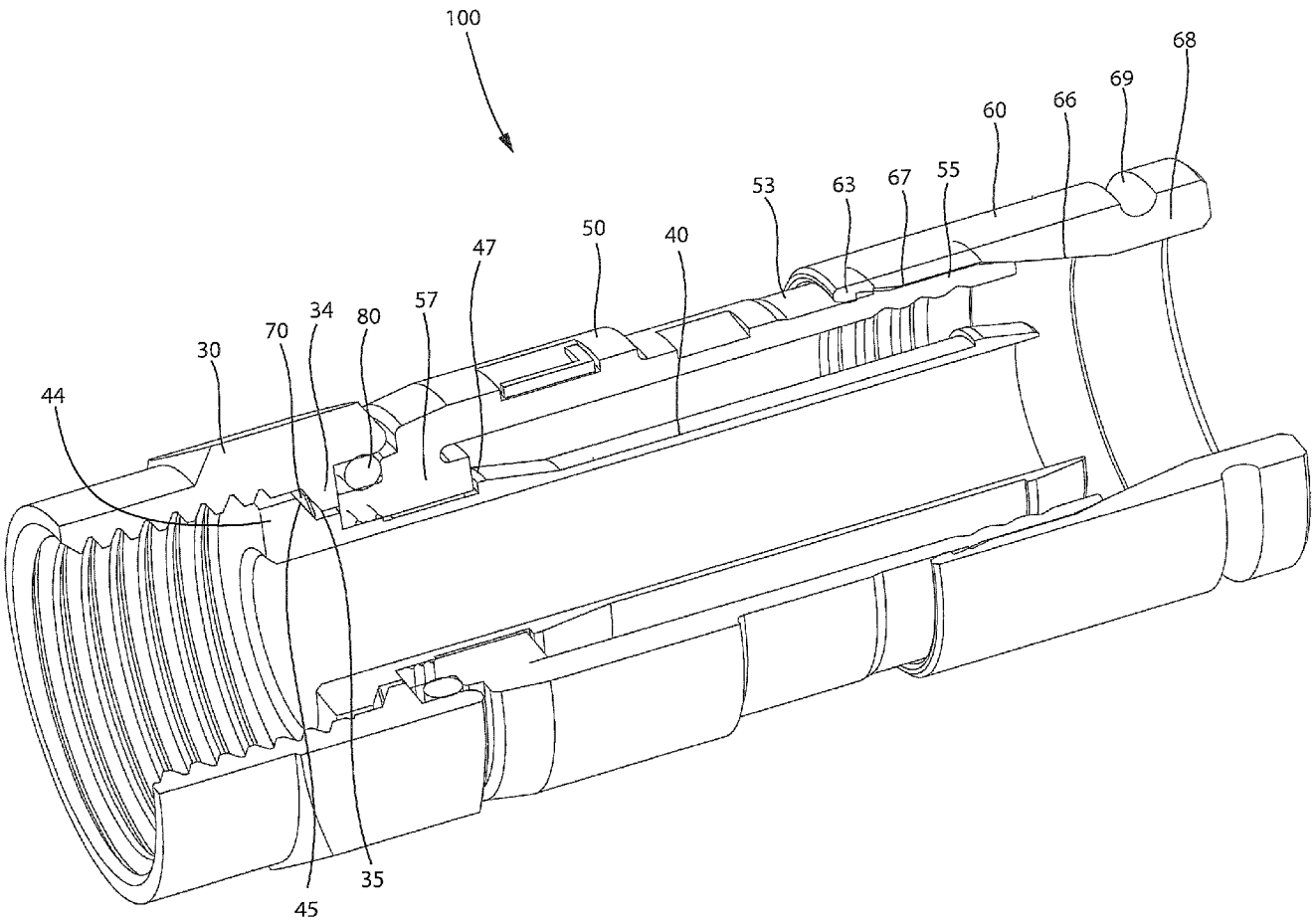
FIG. 4 depicts a perspective cut-away view of an embodiment of an assembled continuity connector, in accordance with the present invention.

Turning now to FIGS. 2-4, an embodiment of a continuity connector 100 is shown during assembly and as assembled. A continuity member 70 may positioned around an external surface of the post 40 during assembly, while the post 40 is axially inserted into position with respect to the nut 30. The continuity member 70 should have an inner diameter sufficient to allow it to move up the entire length of the post body 40 until it contacts the tapered surface 45 of the flange 44 (as depicted in FIG. 3). The body sealing member 80, such as an O-ring, may be located in the second end of the nut 30 in front of the internal lip 34 of the nut, so that the sealing member 80 may compressibly rest between the nut 30 and the connector body 50. The body sealing member 80 may fit snugly over the portion of the body 50 corresponding to the annular recess 58 proximate the first end 51 of the body 50. However, those in the art should appreciate that other locations of the sealing member corresponding to other structural configurations of the nut 30 and body 50 may be employed to operably provide a physical seal and barrier to ingress of environmental contaminants. The nut 30 may be spaced apart from the connector body 50 and may not physically and electrically contact the connector body 50. Moreover, the body sealing member 80 may serve to, in some manner, prevent physical and electrical contact between the nut 30 and the connector body 50.

When assembled, as in FIG. 4, embodiments of a continuity connector 100 may have axially, radially, and/or rotationally secured components. For example, the body 50 may obtain a physical interference fit with portions of the post 40, thereby securing those two components together. The flange 44 of the post 40 and the internal lip 34 of the nut 30 may work to restrict axial movement of those two components with respect to each other. Moreover, the configuration of the body 50, as located on the post 40, when assembled, may also restrict axial movement of the nut 30. However, the assembled configuration should not prevent rotational movement of the nut 30 with respect to the other continuity connector 100 components. In addition, when assembled, embodiments of a continuity member 100 have a fastener member 60 may be configured in a way that the fastener member 60 is secured to a portion of the body 50 so that the fastener member 60 may have some slidable axial freedom with respect to the body 50, thereby permitting operable compression of the fastener member 60 onto the connector body 50 and attachment of a coaxial cable 10. The fastener member 60 may be operably slidably secured to the connector body 50. Notably, when embodiments of a continuity connector 100 are assembled, the continuity member 70 is disposed between the tapered surface 35 of the internal lip of the nut 30 and the tapered surface 45 of the flange 44 of the post, so that the continuity member 70 continuously physically and electrically contacts both the nut 30 and the post 40.

During assembly of a continuity connector 100 (as in FIGS. 2-3), the continuity member 70 may be mounted on the post 40 proximate the first end 41 of the post 40. Then the post 40, with the continuity member 70 mounted thereon, may be axially inserted through each of the nut 30 (starting at the first end 31 of the nut 30), the seal member 80, and the connector body 50 (starting at the first end 51 of the connector body 50) until the applicable components are axially secured with respect to one another (as in FIGS. 4-5). Once assembled, the continuity member is disposed between and contacts both the tapered surface 35 of the internal lip 34 of the nut 30 and the correspondingly oppositely tapered surface 45 of the flange 44 of the post 40, so that the continuity member 70 resides in a pre-load condition wherein the continuity member 70 experiences constant compression force(s) exerted upon it by both the tapered surface 35 of the lip 34 of the nut 30 and the tapered surface 45 of the flange 44 of the post 40. As such, the pre-load condition of the continuity member 70, when embodiments of a continuity connector 100 are in an assembled state, exists such that the continuity member 70 endures a constant moment, in an axial direction, resulting from the contact forces of the opposite tapered surfaces 35 and 45 of the nut 30 and post 40. The pre-load condition of the continuity member 70 involving a constant moment and continuous motive contact between the oppositely tapered surfaces 35 and 45 of the nut 30 and the post 40 facilitates an electrical ground path between the post 40 and the nut 30. In addition, the pre-load continuous contact condition of the continuity member 70 between the oppositely tapered surfaces 35 and 45 exists during operable rotational coaxial movement of the nut 30 about the post 40. Moreover, if the nut 30, as operably axially secured with respect to the pos, wiggles or otherwise experiences some amount of axial movement with respect to the post 40, either during rotation of the nut 30 or as a result of some other operable movement of the continuity connector 100, then the assembled pre-load compressed resilient condition of the continuity member 70 between the tapered surfaces 35 and 45 helps ensure constant physical and electrical contact between the nut 30 and the post 40. Hence, even if there is rotational or axial movement or other wiggling that occurs between the nut 30 and the post 40, the continuity member 70, as existent in a pre-loaded compressed condition by the resultant moment exerted by the oppositely tapered surfaces 35 and 45, the electrical continuity between the nut 30 and the post 40 is maintained. Because the continuity member 70 endures the moment resulting from the contact forces of the opposite tapered surfaces 35 and 45 of the nut and the post when the continuity connector 100 is assembled the continuity member 70 resists axial wiggle movement between the post 40 and the nut 30.

Figure 5:
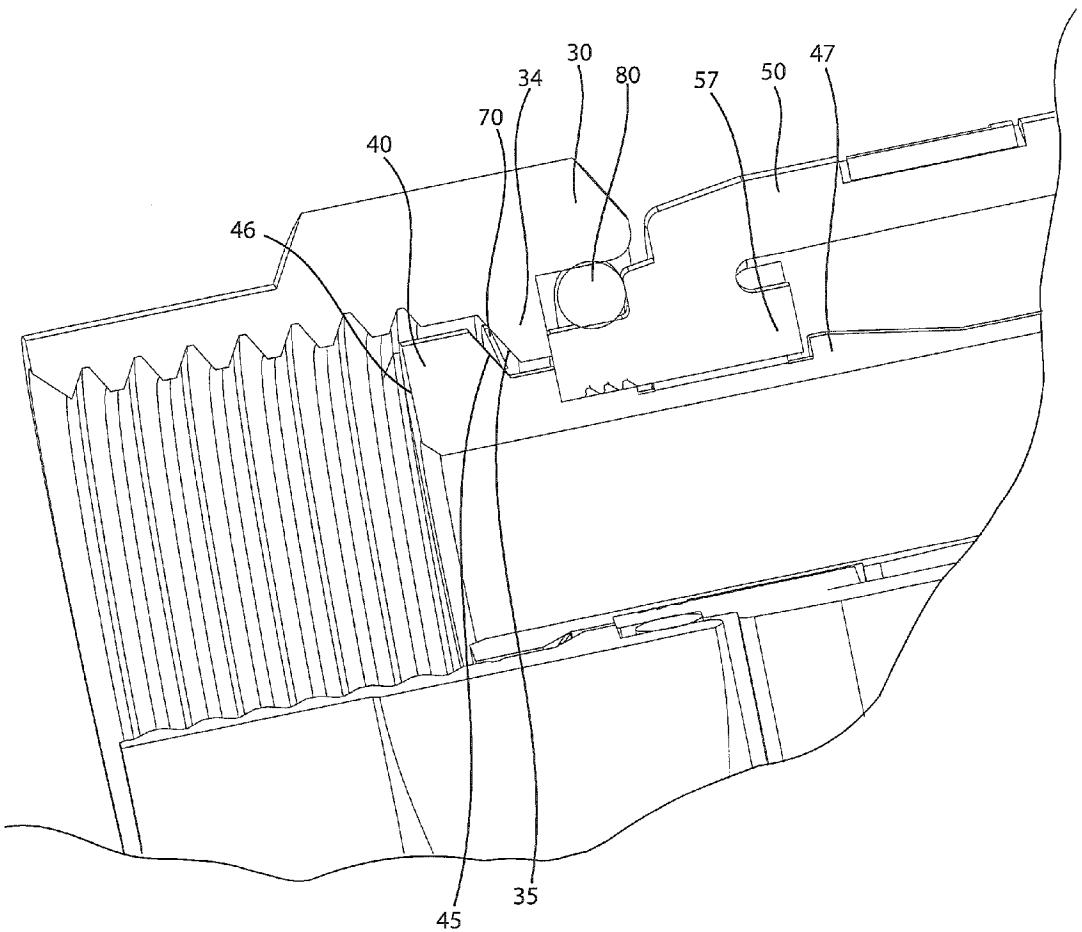
FIG. 5 depicts a perspective cut-away view of a portion of an embodiment of an assembled continuity connector, in accordance with the present invention.

With further reference to the drawings, FIG. 5 depicts a close-up perspective cut-away view of a portion of an embodiment of an assembled continuity connector 100. One advantage of the structure of a continuity connector 100 is that the corresponding tapered surfaces 35 and 45 have greater surface area for physical and electrical interaction than if the surfaces 35 and 45 were merely perpendicularly/radially oriented. Another advantage is that the tapered surfaces 35 and 45 act to generate a moment for pre-load forces resultant upon a continuity member 70 positioned therebetween. The pre-load forces are beneficial in that they tend the continuity member 70 toward responsive electrical and physical contact with both the nut 30 and the post 40, thereby ensuring ground continuity between the connector 100 components. A continuous ground path is located between the nut 30 and the post 40. The ground path is facilitated by the disposition of the continuity member 70 as being positioned between the tapered surface 35 of the nut 30 and the tapered surface 45 of the post 40 to continuously contact the nut 30 and the post under 40 a pre-load condition. When the continuity member 70 resides in a pre-load condition, the continuity member 70 is continuously compressed by a resultant moment existent between oppositely tapered surfaces 35 and 45 of the nut 30 and the post 40, when the continuity connector 100 is assembled. Known coaxial cable connectors 100 may include conductive implements located between the nut and the post. However, when such known connectors are operably assembled, the conductive implements do not reside in a pre-loaded or otherwise compressed condition between tapered surfaces. As pertaining to known connectors, electrical continuity is not continuous from the point of assembly, because it is only when compression forces are introduced by attachment of the known connectors to an interface port 20, that the conductive implements between the post and the nut experience compressive forces and work to extend continuous conductivity therebetween.

Embodiments of a coaxial cable continuity member 100 include means for extending a continuous electrical ground path between the nut 30 and the post 40. The means include securely locating a continuity member 70 in a pre-load condition between the nut 30 and the post 40, when the coaxial cable continuity connector 100 is assembled. The means invoke a moment existent between opposing surfaces 35 and 45 of the nut 30 and the post 40, when the coaxial cable continuity connector 100 is assembled, because the opposing surfaces compress the continuity member in different radial locations thereby generating an axial bending force on the continuity member 70. As the continuity member 70 resists the moment it retains continuous contact with the nut 30 and the post 40, even during rotational movement of the nut 30 about the post 40 or during axial wiggling between the nut 30 and the post 40.

One embodiment of a continuity member 70 is a simple ring washer, as depicted in the drawings. However, those in the art should appreciate that the continuity member 70 may comprise a lock washer, including a split ring lock washer (or "helical spring washer"), an external tooth washer, and an internal tooth washer. Any type of lock washer is contemplated, including countersunk and combined internal/external washers. Also, any material for the continuity member 70 having a suitable resiliency is contemplated, including metal and conductive plastic. The continuity member 70 is generally arcuately shaped to extend around the tubular post 40 over an arc of at least 225 degrees, and may extend for a full 360 degrees. This arcuately shaped continuity member 70 may also be in the form of a generally circular broken ring, or C-shaped member. In one embodiment, the continuity member 70 may be generally circular and may include a plurality of projections extending outwardly therefrom for engaging the tapered surface 35 of the nut 30. In another embodiment, the continuity member 70 may be generally circular and may include a plurality of projections extending inwardly therefrom for engaging the tubular post 40. Following assembly, when forces are applied by contact with the corresponding oppositely tapered surfaces 35 and 45 of the nut 30 and post 40, the continuity member 70 is resilient relative to the longitudinal axis of the continuity connector 100, and is compressed and endures a resultant moment between the tapered surface 35 and the tapered surface 45 to maintain rotatable sliding electrical contact between the flange 44 of the tubular post 40 (via its tapered surface 45) and the internal lip 34 of the coupler nut 30 (via its tapered surface 35).

When a continuity connector 100 is assembled, the continuity member 70 contacts both the tubular post 40 and the coupling nut 30 for providing an electrically-conductive path therebetween, but without restricting rotation of the coupling nut 30 relative to the tubular post 40. The spring action of the continuity member 70 resulting from the moment generated by contact with the oppositely tapered surfaces 35 and 45 serves to form a continuous ground path from the coupling nut 30 to the tubular post 40 while allowing the coupling nut 30 to rotate, without any need for compression forces generated by attachment of the connector 100 to an interface port 20. Another benefit of the corresponding oppositely tapered surfaces 35 and 45 of the nut 30 and post 40 is that the non-axially-perpendicular structure facilitates initiation of physical and electrical contact by a continuity member 70 that obtains a pre-loaded electrically grounded condition when positioned therebetween when the continuity connector 100 is assembled.

Figure 6:
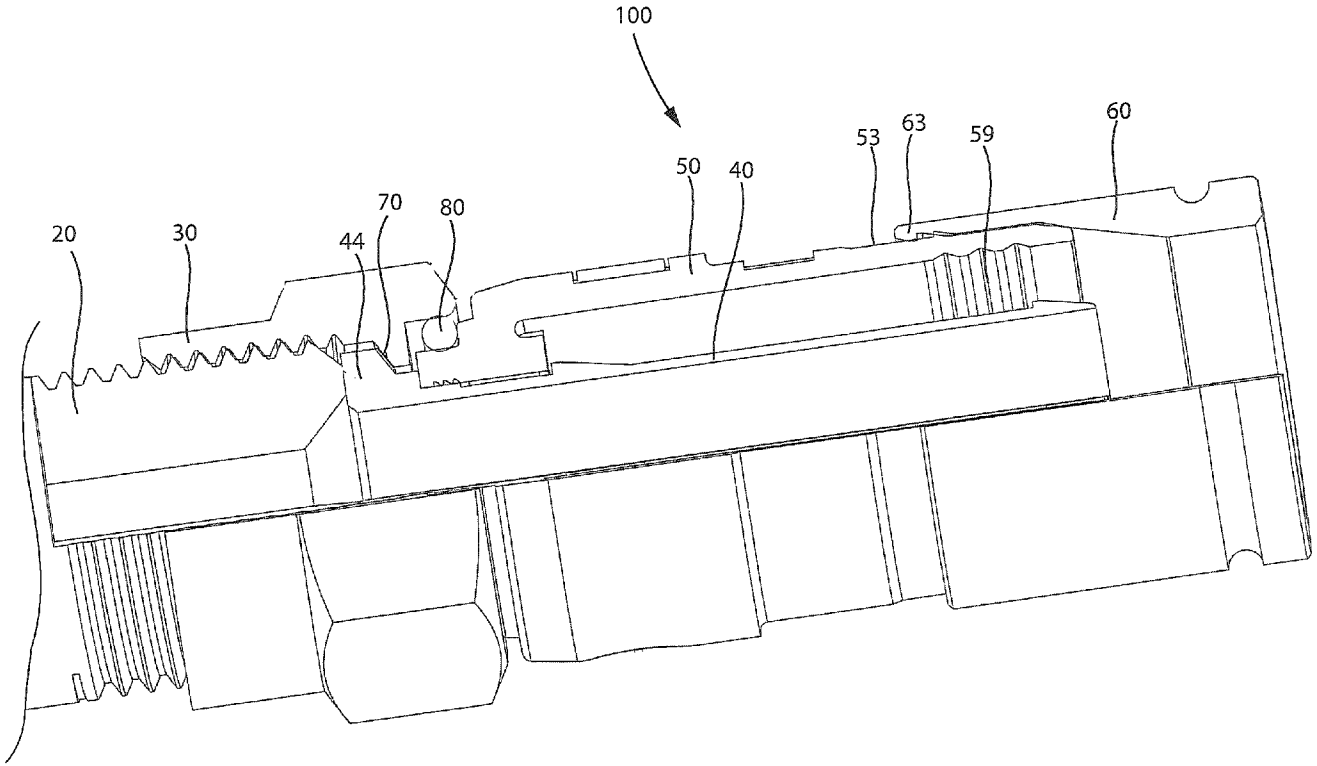
FIG. 6 depicts a perspective cut-away view of an embodiment of a continuity connector fully tightened onto an interface port, in accordance with the present invention.
Figure 7:
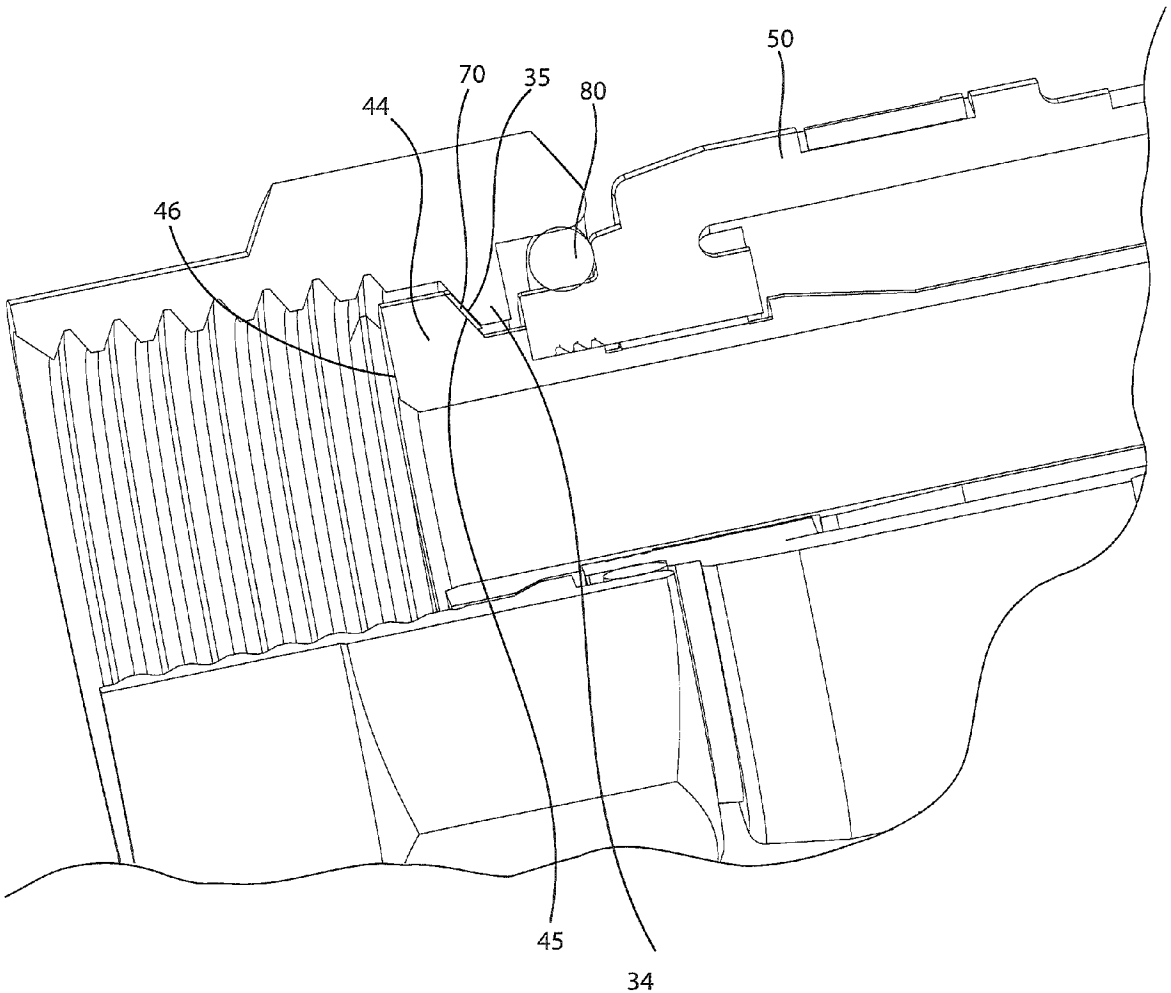
FIG. 7 depicts a perspective cut-away view of an embodiment of a continuity connector in a fully tightened configuration, in accordance with the present invention.

Turning now to FIGS. 6-8, an embodiment of a continuity connector 100 is depicted in a fully tightened position. As depicted, the continuity member 70 has been fully compressed between the corresponding tapered surfaces 35 and 45 of nut 30 and post 40. With regard to a continuity member 70 comprising a simple ring washer, since the continuity member 70 starts out as a flat member having an annularly ring extending radially in an axially perpendicular orientation, the tapered surfaces 35 and 45 act to create a spring bias (or preload) as the member 70 is flexed into a somewhat conical shape (as partially depicted in FIG. 5), or otherwise non-radial orientation. The use of a flat washer continuity member 70 is beneficial because it allows the use of already existing components, which reduces cost of implementing the improvement in production and assembly of continuity connector embodiments 100. A further benefit of the corresponding oppositely tapered surfaces 35 and 45 is enhanced moisture sealing and increased resistance to loosening when fully tight.

With continued reference to the drawings, FIG. 9 depicts a perspective cut-away view of an embodiment of a continuity connector having an attached coaxial cable, the connector in a not fully tightened position on an interface port. As depicted, the connector 100 is only partially installed on the interface port 20. However, while in this partially installed state, the continuity member 70 maintains an electrical ground path between the mating port 20 and the outer conductive shield (ground 14) of cable 10. The ground path, among other things, results from the continuous physical and electrical contact of the continuity member 70, as compressed by forces resulting in a moment between the oppositely tapered surfaces 35 and 45 of the nut 30 and the post 40, when the continuity connector 10 is in an operably assembled state. The ground path extends from the interface port 20, to and through the nut 30, to and through the continuity member 70, to and through the post 40, to the conductive grounding shield 14. This continuous grounding path provides operable functionality of the continuity connector 100, even when the connector 100 is not fully tightened onto an interface port 20.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable continuity connector comprising;

a connector body;

a post engageable with the connector body, wherein the post includes a flange having a tapered surface;

a nut, wherein the nut includes an internal lip having a tapered surface, wherein the tapered surface of the nut oppositely corresponds to the tapered surface of the post when the nut and post are operably axially located with respect to each other when the coaxial cable continuity connector is assembled; and a continuity member disposed between and contacting the tapered surface of the post and the tapered surface of the nut, so that the continuity member endures a moment resulting from the contact forces of the opposite tapered surfaces, when the continuity connector is assembled;

wherein as the continuity member endures the moment resulting from the contact forces of the opposite tapered surfaces, when the connector is assembled, the continuity member maintains continuous physical and electrical contact between the post and the nut; and wherein the continuity member is a flat washer.

2. The connector of claim 1, wherein the flat washer is flexed into a somewhat conical shape as it endures the moment resulting from the contact forces of the opposite tapered surfaces when the connector is assembled.

3. The connector of claim 1, wherein, as the continuity member endures the moment resulting from the contact forces of the opposite tapered surfaces when the connector is assembled, the continuity member resists axial wiggle movement between the post and the nut.

4. The connector of claim 1, wherein the nut is spaced apart from and does not contact the connector body.

5. The connector of claim 1, further comprising a body sealing member disposed between the nut and the connector body.

6. The connector of claim 1, further comprising a fastener member slidably secured to the connector body, wherein the fastener member includes an internal ramped surface that acts to deformably compress the outer surface the connector body when the fastener member is operated to secure a coaxial cable to the coaxial cable continuity connector.

7. A coaxial cable continuity connector comprising;

a connector body a nut rotatable with respect to the connector body, wherein the nut includes an internal lip having a tapered surface;

a post securely engageable with connector body, wherein the post includes a flange having a tapered surface, wherein the tapered surface of the post oppositely corresponds to the tapered surface of the nut when the post and the nut are operably axially located with respect to each other, when the coaxial cable continuity connector is assembled; and a continuous ground path located between the nut and the post, the ground path facilitated by the disposition of a continuity member positioned between the tapered surface of the nut and the tapered surface of the post to continuously contact the nut and the post under a preload condition, wherein the continuity member is continuously compressed by a resultant moment existent between oppositely tapered surfaces of the nut and the post, when the continuity connector is assembled; and wherein the continuity member is a flat washer.

8. The connector of claim 7, wherein the flat washer is flexed into a somewhat conical shape as it endures the moment resulting from the contact forces of the opposite tapered surfaces when the connector is assembled.

9. The connector of claim 7, wherein, as the continuity member endures the moment resulting from the contact forces of the opposite tapered surfaces when the connector is assembled, the continuity member resists axial wiggle movement between the post and the nut.

10. The connector of claim 7, wherein the nut is spaced apart from and does not contact the connector body.

11. The connector of claim 7, further comprising a body sealing member disposed between the nut and the connector body.

12. The connector of claim 7, further comprising a fastener member slidably secured to the connector body, wherein the fastener member includes an internal ramped surface that acts to deformably compress the outer surface the connector body when the fastener member is operated to secure a coaxial cable to the coaxial cable continuity connector.

13. A method of extending an electrical ground path from a coaxial cable, through a coaxial cable connector, to an interface port, the method comprising:

providing a coaxial cable continuity connector including:

a connector body;

a post engageable with connector body, wherein the post includes a flange having a tapered surface;

a nut, wherein the nut includes an internal lip having a tapered surface, wherein the tapered surface of the nut oppositely corresponds to the tapered surface of the post when the nut and post are operably axially located with respect to each other when the coaxial cable continuity connector is assembled; and a continuity member disposed between and contacting the tapered surface of the post and the tapered surface of the nut, so that the continuity member endures a moment resulting from the contact forces of the opposite tapered surfaces, when the continuity connector is assembled;

wherein as the continuity member endures the moment resulting from the contact forces of the opposite tapered surfaces, when the connector is assembled, the continuity member maintains continuous physical and electrical contact between the post and the nut;

assembling the coaxial cable continuity connector;

operably attaching a coaxial cable to the coaxial cable continuity connector in a manner that electrically integrates the post and an outer conductor of the coaxial cable; and installing the assembled connector, having the attached coaxial cable, to an interface port to extend an electrical ground path from the coaxial cable, through the port and the nut of the coaxial cable continuity connector, to the interface port; and wherein the continuity member is a flat washer.

14. The method of extending an electrical ground path from a coaxial cable, through a coaxial cable connector, to an interface port of claim 13, wherein the flat washer is flexed into a somewhat conical shape as it endures the moment resulting from the contact forces of the opposite tapered surfaces when the connector is assembled.

15. The method of extending an electrical ground path from a coaxial cable, through a coaxial cable connector, to an interface port of claim 13, wherein the nut is spaced apart from and does not contact the connector body.

* * * * *